US010798976B2

(12) United States Patent
Berkowitz

(10) Patent No.: US 10,798,976 B2
(45) Date of Patent: Oct. 13, 2020

(54) GARMENT WITH ENHANCED STRETCH FEATURE

(71) Applicant: OMNIKIT BRANDS, LLC, New York, NY (US)

(72) Inventor: Michael H. Berkowitz, New York, NY (US)

(73) Assignee: OMNIKIT BRANDS, LLC, New York, NY (US)

( * ) Notice: Subject to any disclaimer, the term of this patent is extended or adjusted under 35 U.S.C. 154(b) by 214 days.

(21) Appl. No.: 15/707,349

(22) Filed: Sep. 18, 2017

(65) Prior Publication Data

US 2019/0082745 A1 Mar. 21, 2019

(51) Int. Cl.
*A41B 9/02* (2006.01)
*A41D 27/24* (2006.01)

(52) U.S. Cl.
CPC ..... *A41B 9/02* (2013.01); *A41B 9/023* (2013.01); *A41D 27/24* (2013.01); *A41B 2300/35* (2013.01); *A41B 2500/10* (2013.01)

(58) Field of Classification Search
CPC ..... A41B 9/02; A41B 9/023; A41B 9/004; A41B 2300/35; A41B 2500/10; A41B 9/001; A41D 27/24
USPC ..... 2/73, 78.1, 78.3, 400, 403, 404, 405
See application file for complete search history.

(56) References Cited

U.S. PATENT DOCUMENTS

| | | | | |
|---|---|---|---|---|
| 2,035,604 | A * | 3/1936 | Ide | A41B 9/02 602/67 |
| 3,083,710 | A * | 4/1963 | Rauser | A41B 9/02 602/67 |
| 3,088,121 | A * | 5/1963 | Stedman | A41B 9/02 2/401 |
| 3,517,666 | A * | 6/1970 | Atlee | A41B 9/02 602/68 |
| 5,984,910 | A * | 11/1999 | Berke | A41B 9/023 128/854 |
| 7,676,853 | B1 * | 3/2010 | Cutlip | A41B 9/023 2/400 |
| 7,958,571 | B2 | 6/2011 | Kitsch | |
| 9,375,035 | B1 * | 6/2016 | Ingels | A41B 9/02 |
| 2008/0178369 | A1 * | 7/2008 | Kitsch | A41B 9/023 2/405 |
| 2012/0204325 | A1 * | 8/2012 | Todd | A41B 9/02 2/404 |
| 2014/0018762 | A1 * | 1/2014 | Vignali | A61F 13/49006 604/385.14 |

(Continued)

*Primary Examiner* — Sally Haden
(74) *Attorney, Agent, or Firm* — Notaro, Michalos & Zaccaria P.C.

(57) ABSTRACT

An undergarment that provides improved seam stretch, includes a center-front pouch, a front-side-and-rear panel and, in some embodiments, a crotch gusset panel. The front-side-and-rear panel is joined to the center-front pouch on either side of the center-front pouch. The center-front pouch is composed of two layers of material, an inner layer and an outer layer, the inner and outer layers and being joined by a center seam of the center-front pouch. In certain embodiments, each leg hem is a combination feature comprising a self-turnback fold, bonded with adhesive stretch tape. In certain embodiments, a seam allowance of the center-front pouch seam of the center-front pouch is folded within the inner layer and the outer layer of the center-front pouch.

21 Claims, 12 Drawing Sheets

(56) References Cited

U.S. PATENT DOCUMENTS

| | | | | |
|---|---|---|---|---|
| 2015/0290049 | A1* | 10/2015 | Riha-Scott | A41B 9/004<br>604/387 |
| 2017/0099881 | A1* | 4/2017 | Travisano | A41B 9/023 |
| 2017/0290374 | A1* | 10/2017 | Biodrowski | A41B 9/004 |

* cited by examiner

GARMENT WITH ENHANCED STRETCH FEATURE

FIELD AND BACKGROUND OF THE INVENTION

The present invention relates generally to the field of garments, and, in particular, to a garment that provides improved seam stretch for comfort and support. The garments of the invention may be undergarments such as briefs, boxer briefs, cycling shorts, base layers, running tights or any other types of stretchable garments.

Chafing is the irritating and often painful result of skin rubbing against skin or clothing. Chafing can occur anywhere on the body. However, the thighs and groin are particularly vulnerable, particularly for participants in sports that involve leg movement, such as running and cycling. Severe chafing is known as friction burn.

To help address the problem of chafing, individuals have employed various lubes. These lubes are often messy and uncomfortable. In addition, in particular in long distance events, the lubes often lose their effect. One solution to this problem has been to carry the lube container while running or cycling. However, this solution presents obvious problems and inconvenience.

As will be explained more fully later in this disclosure, the current invention originates from the realization that garments are needed that optimally and flexibly secure the male genitals in place, and avoid their contact with the garment, in particular with the stitching of the seams, as well as with the inner thighs of the wearer.

SUMMARY OF THE INVENTION

It is an object of the present invention to provide an undergarment which provides flexible support for the genitalia.

It is a further object to provide an undergarment which avoids chafing contact of the genitalia with the garment, in particular the stitching of the garment, and with other body parts, in particular the inner thighs.

These and other objects are achieved by an undergarment, including a center-front pouch, a front-side-and-rear panel and a crotch gusset panel. The front-side-and-rear panel is joined to the center-front pouch at least partially on either side of the center-front pouch. The front-side-and-rear panel is joined to the center-front pouch by a pair of convex outer seams. The center-front pouch defines a peak, the peak effected by the convex tracking of the convex outer seams away from an axis defined by the center seam. In these embodiments, the crotch gusset panel bounds the center-front pouch along the bottom edge of the center-front pouch, the crotch gusset panel extends laterally along a bottom edge of the center-front pouch and a bottom edge of the front-side-and-rear panel, and the crotch gusset panel shares common seams with each of the center-front pouch and the front-side-and-rear panel. The center-front pouch is composed of two layers of material, an inner layer and an outer layer, the inner and outer layers and being joined by a center seam of the center-front pouch.

These and other objects are also achieved by an undergarment embodiment including a center-front pouch and a front-side-and-rear panel, in which the front-side-and-rear panel bounds the center-front pouch at least partially on either side of the center-front pouch, the center-front pouch is composed of two layers of material, an inner layer and an outer layer, the inner and outer layers and being joined by a center seam of the center-front pouch. In these embodiments, the inner layer and the outer layer of the center-front pouch are joined at the central seam but are separated along their respective outer edges. The inner layer has a cut edge with no self-turnback. A hem line of the outer layer of the center-front pouch is finished with a self-turnback hem.

In these embodiments, the center-front pouch and the side-and-rear panel cooperate to define leg openings.

Also, in these embodiments, the inner pouch layer is detached from the leg hem.

As well the cut edge of the inner layer is bonded on one side with adhesive stretch tape, in order to keep the fabric edge laying flat and prevent the fabric edge from curling. In these embodiments, the self-turnback hem of the outer layer of the center-front pouch is bonded with adhesive stretch tape, and creates a stretch hem without the use of any added elastic tape trims or components.

These embodiments, also include an elasticized hem portion along at least one edge of the front-side-and-rear panel.

The various features of novelty which characterize the invention are pointed out with particularity in the claims annexed to and forming a part of this disclosure. For a better understanding of the invention, its operating advantages and specific objects attained by its uses, reference is made to the accompanying figures and descriptive matter in which preferred embodiments of the invention are illustrated.

DESCRIPTION OF THE PREFERRED EMBODIMENTS

Figure 1:
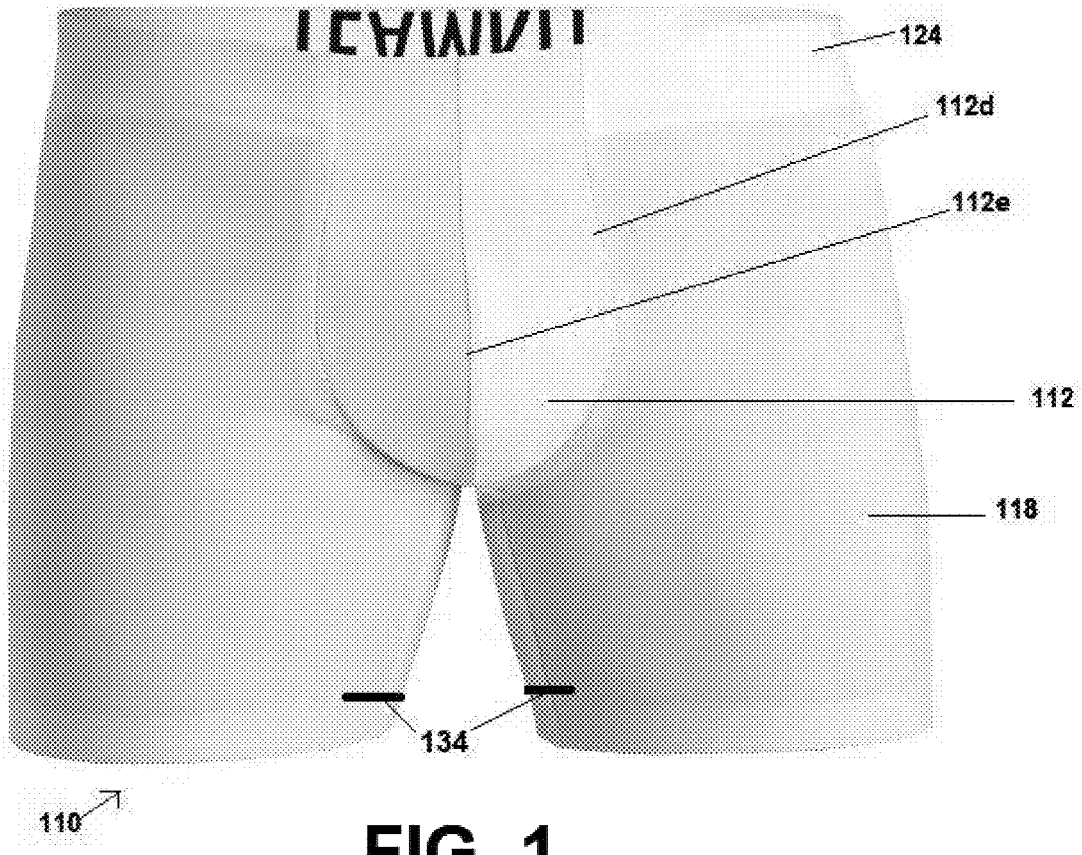
FIG. 1 is a front view of the outside of the boxer brief embodiment according to the present invention.

Referring now to the drawings, in which like reference numerals are used to refer to the same or similar elements, FIGS. 1 to 6 illustrate one embodiment of the invention in the form of a garment with legs 110. Although the figures illustrate a boxer brief, this is for illustration purposes only, as the garment with legs 110 according to the present invention encompasses any number of garments having legs including, but not limited to, boxer briefs, cycling shorts, base layers, running tights, or any other type of garment which may incorporate the features described herein.

Figure 2:
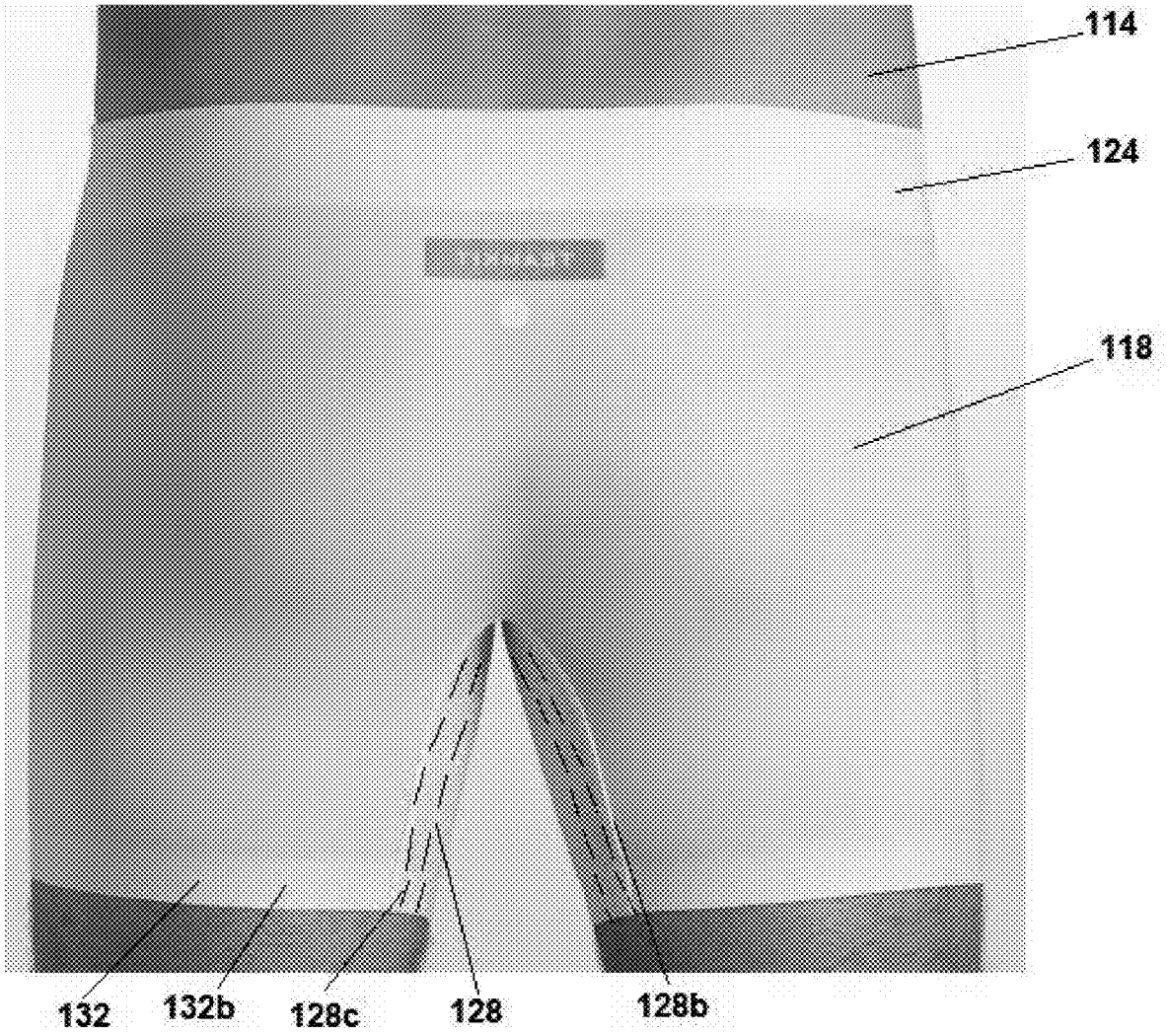
FIG. 2 is a rear view of the outside of the boxer brief embodiment according to the present invention.
Figure 3:
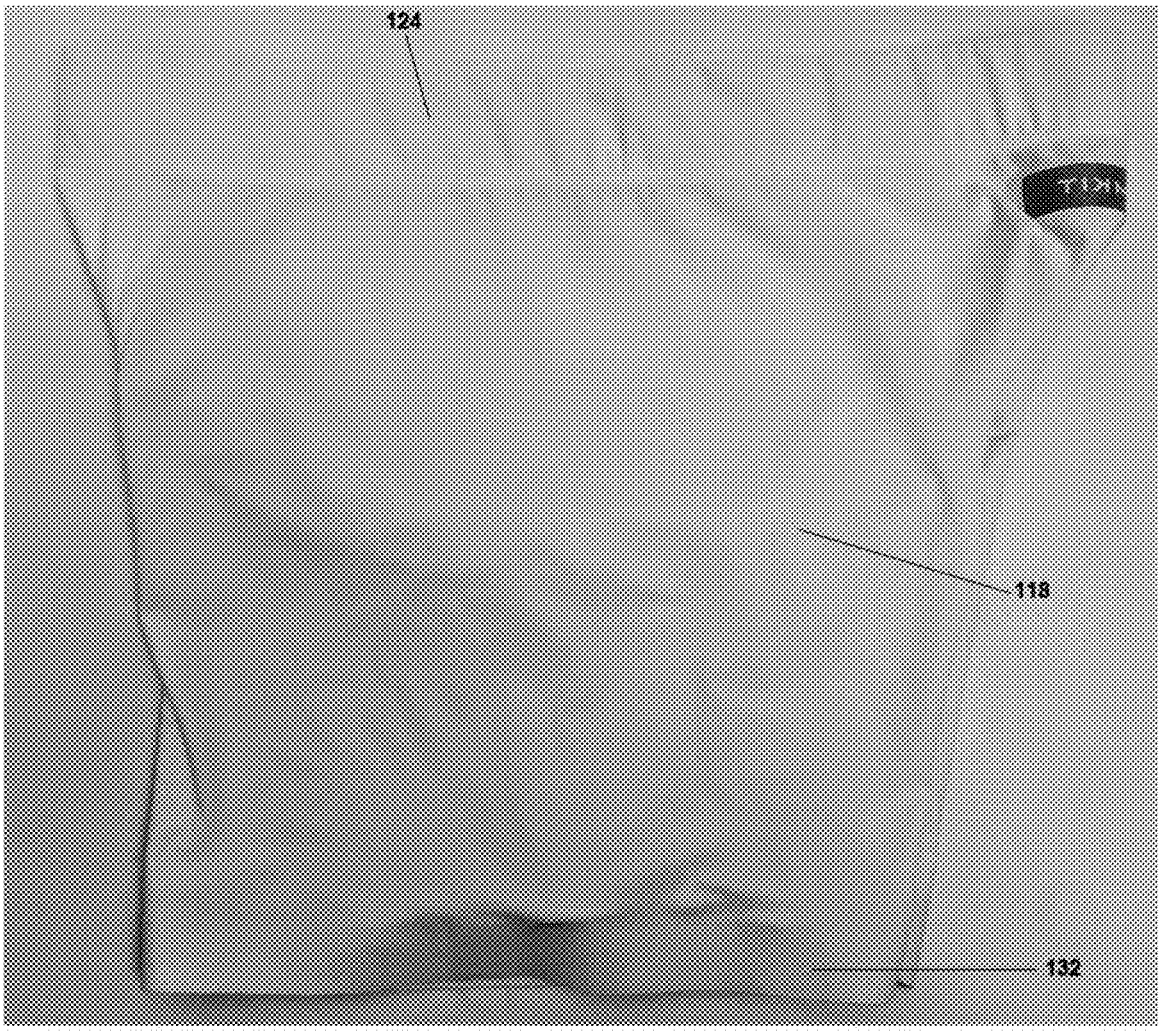
FIG. 3 is a side view of the outside of the boxer brief embodiment according to the present invention.

FIGS. 1, 2 and 3 show front, rear, and side views, respectively, of the outside of the garment with legs 110 according to the present invention. The garment with legs 110 includes a center-front pouch 112, a front-side-and-rear panel 118, and a crotch gusset panel 128. The center-front pouch 112 is a pouch or cup like feature shaped to support male genitals and separate them from direct contact with the skin of the inner thigh region of the wearer 114. The front-side-and-rear panel 118 bounds the center-front pouch 112 on either side. The crotch gusset panel 128 is a panel of fabric, typically a single layer of fabric that connects to the front and back of the garment with legs 110, in the manner detailed below. The crotch gusset panel 128 creates extra width and volume between the leg areas in the front and back of the garment thus making it more comfortable and easier to walk, run or sit.

In preferred embodiments, the center-front pouch 112, the front-side-and-rear panel 118 and the crotch gusset panel 128 are each made of stretch-knit fabric. In preferred embodiments, the stretch-knit fabric has a weight in the range of 167 $g/m^2$ to 220 $g/m^2$.

Figure 4:
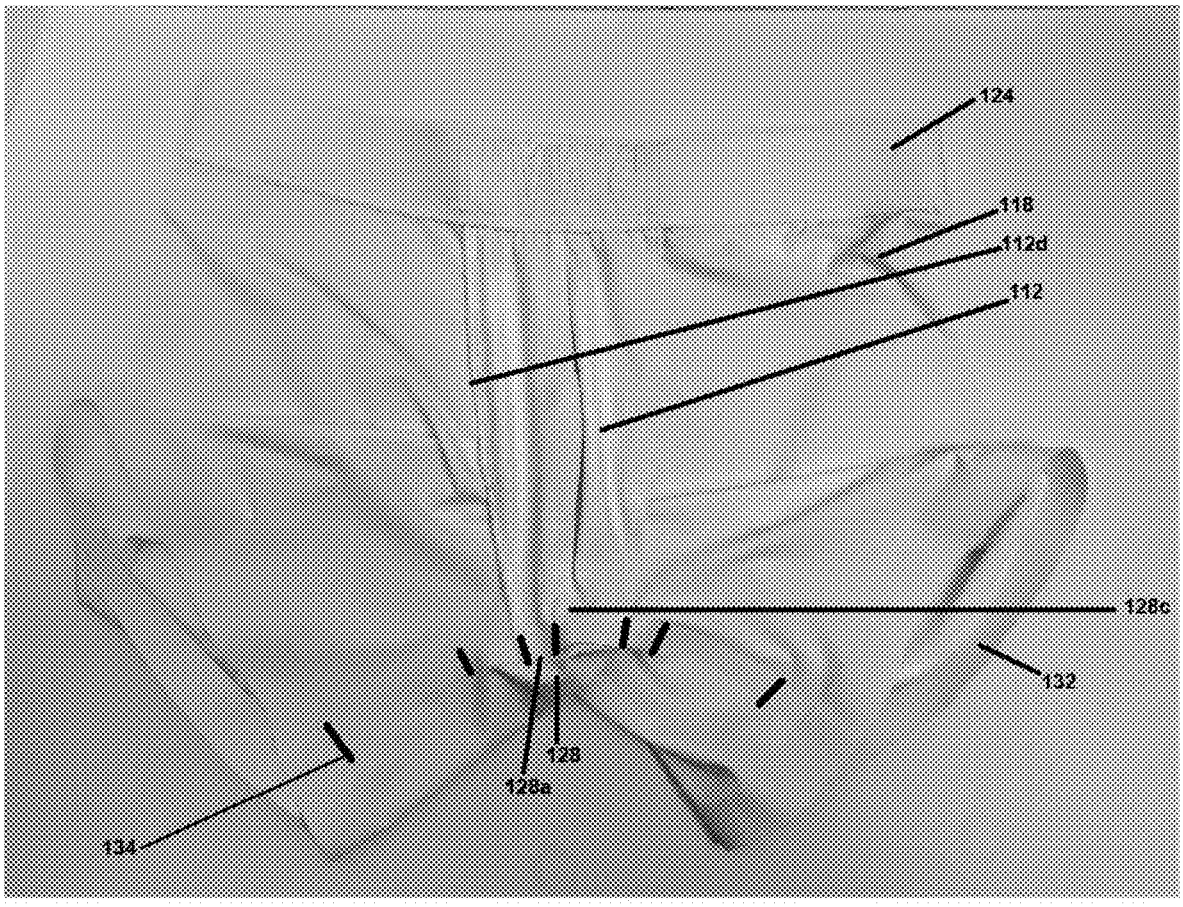
FIG. 4 is a front view of the interior of the boxer brief embodiment according to the present invention.
Figure 5:
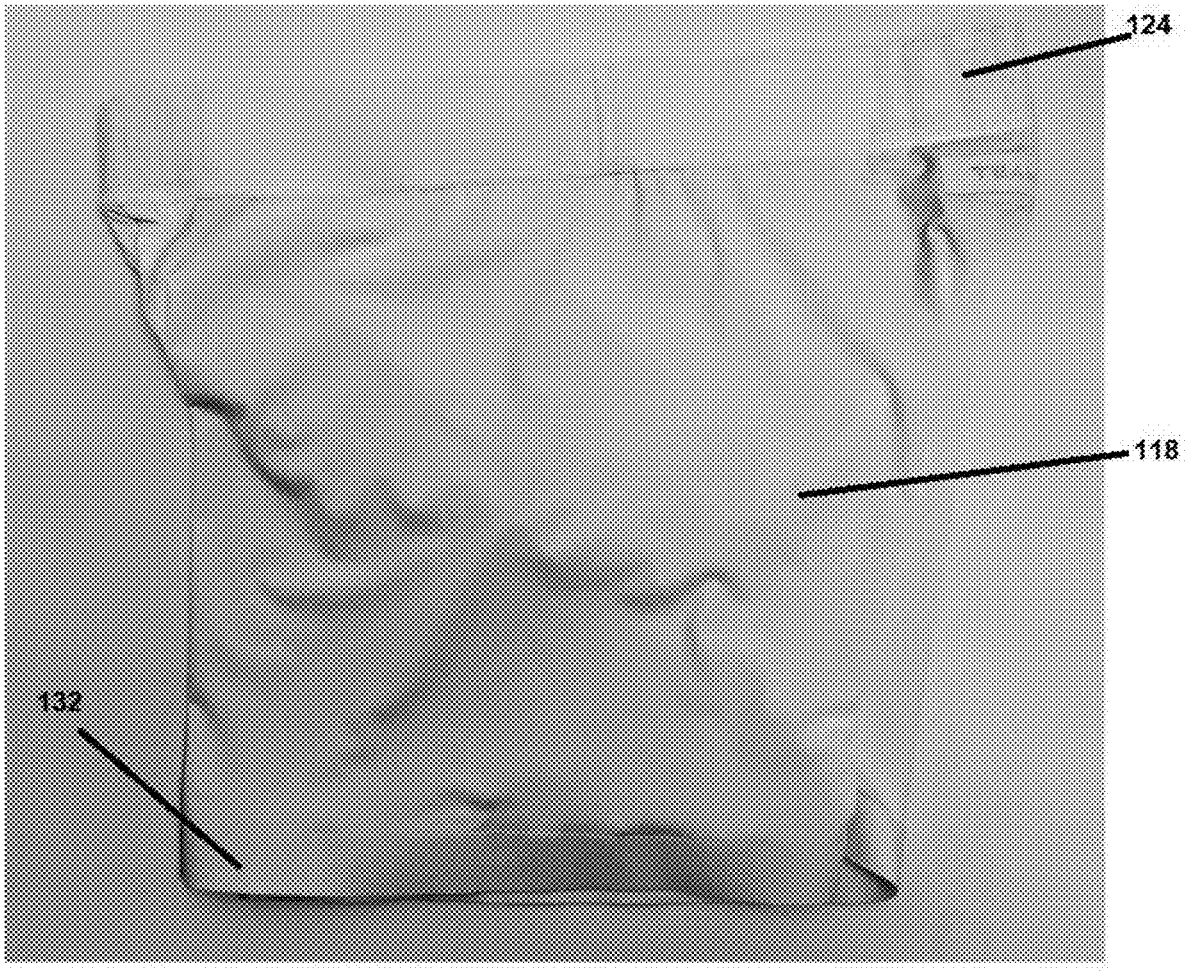
FIG. 5 is a side view of the interior of the boxer brief embodiment according to the present invention.
Figure 6:
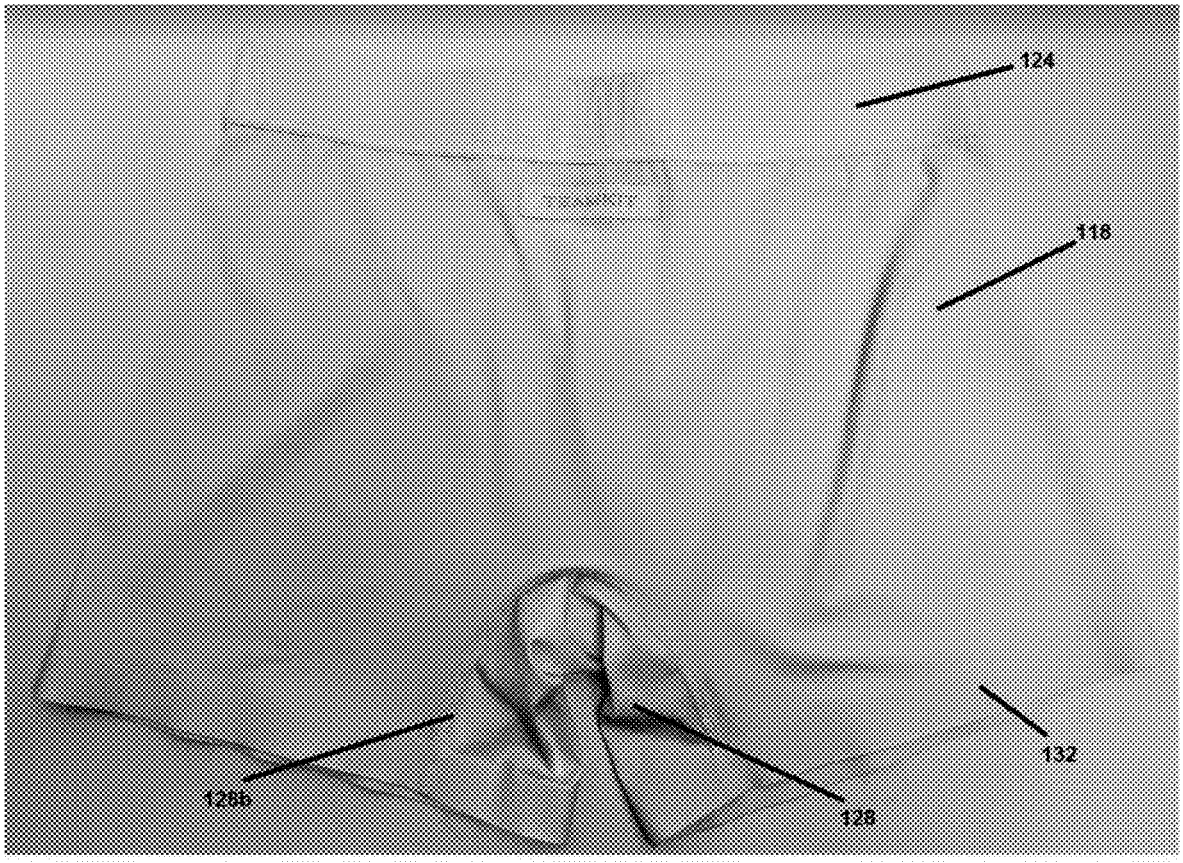
FIG. 6 is a rear view of the interior of the boxer brief embodiment according to the present invention.

FIGS. 1 and 4 show front exterior and front interior views, respectively, of the garment with legs 110. In preferred embodiments, the center-front pouch 112 is composed of two layers of material, an inner layer 110 and an outer layer 112*b*. The inner and outer layers 110 and 112*b* are joined by a center seam 112*c* of the center-front pouch 112, which is conventionally sewn with a needle and thread.

As shown in FIG. 1, the center seam 112*c* of the center-front pouch 112 runs from the upper edge of the garment with legs 110 to the lower edge of the center-front pouch 112, where the center-front pouch 112 meets the crotch gusset panel 128.

Still referring to FIG. 1, a pair of convex-shaped outer seams 112*d* of the center front pouch 112 bound the center-front pouch 112 on either side of the center-front pouch 112. The center-front pouch 112 is bounded along its upper edge by the waistband 124. In typical embodiments, the waistband 124 is an elastic belt that supports the garment around the waistline of the wearer 114. The center-front pouch 112 is bordered at its lower and rearmost edge by the crotch gusset panel 128. The tracking of the outer seams 112*d* of the center front pouch 112 divert away from the axis formed by central seam 112*c* to effect an apex 112*e* of the center-front pouch seam 112*c*. This effect helps to further reduce or eliminate the incidence of chafing.

As shown in FIGS. 1, 2 and 4, the crotch gusset panel 128 extends laterally along the bottom edges of the center-front pouch 112 and the front-side-and-rear panel 118, sharing common seams with each of the center-front pouch 112 and the front-side-and-rear panel 118. The crotch gusset panel 128 is joined to the center-front pouch 112 and the front-side-and-rear panel 118 by a front crotch gusset panel seam 128*a*. The crotch gusset panel 128 is also joined to the front-side-and-rear panel 118 by a rear crotch gusset panel seam 128*b*. The present inventor discovered, in developing the present invention, that bonding the outer seams 112*d* to the front-side-and-rear panel 118 optimizes the internal environment and reduces chafing. Thus, as shown in FIG. 4, the outer seams 112*d* are bonded to the front-side-and-rear panel 118. In preferred embodiments, the outer seams 112*d* and the front crotch gusset panel seam 128*a* are each bonded with BEMIS #3914 adhesive stretch tape, available from Bemis Company, Inc. of Neenah, Wis. In preferred embodiments, the BEMIS #3914 adhesive stretch tape used to bond the outer seams 112*d* and the front crotch gusset panel seam 128*a* has a width in the range of 7 mm to 10 mm.

With reference to FIGS. 1, 2 and 4, the front-side-and-rear panel 118 and the crouch gusset panel 128 cooperate to define leg openings. There are provided leg hems 132 at the leg openings. In preferred embodiments, each leg hem 132 is advantageously bonded with BEMIS #3914 adhesive stretch tape. In preferred embodiments, the BEMIS #3914 adhesive stretch tape used to bond the leg hems 132 has a width in the range of 15 mm to 25 mm.

The present inventor has discovered that use of this type of tape not only bonds the garment together but also optimizes the stretch of seams and hems compared to conventionally stitched or needle-thread sewn seams and hems.

Referring to FIG. 1, the center-front pouch seam 112*c* of the center-front pouch 112 is conventionally sewn with needle and thread. The seam allowance of the center-front pouch seam 112*c* is located between the outer and inner layers of the center-front pouch 112. The present inventor has found this to provide the advantageous benefit that the center-front pouch seam never contacts the skin or genitals. As used herein, the term "seam allowance" refers to the extra width of fabric that is beyond the seam line where the garment is stitched.

Still referring to FIGS. 1, 2 and 4, baby bar tacks 134 are provided perpendicular to the front crotch gusset panel seam 126, at the overlap between the base of the center-front pouch 112 and the crotch gusset panel 128, where the crotch gusset panel seam 128 meets the front-side-and-rear panel 118, and where the crotch gusset panel 128 meets each of the leg hems 132 in the front of the garment with legs 110. Baby bar tacks 134 are also located in the rear of the garment with legs 110, perpendicular to the rear crotch gusset panel seam 128*b*, at a location above the edges of the leg hems 132. As it is used herein, the term "baby bar" tack refers to a stitch that is used as a reinforcement for points of strain in clothing consisting of a bar-shaped line of small stitches worked across several threads. The baby bar tacks 134, 234 employed in embodiments according to the present invention are typically 10 mm in length.

With reference to FIG. 4, the seam allowance of the outer seams 112*d* is turned away from each side of the center-front pouch seam 112*c*. As noted above, the term "seam allowance" refers to the extra width of fabric that is beyond the seam line where the garment is stitched.

As noted, the front crotch gusset panel seam 128*a* is bonded along its length with adhesive stretch tape, as shown in FIG. 4. The front crotch gusset panel seam 128*a* is also bonded to the two bonded outer seams 112*d* of the center front pouch 112. The inventor has discovered that, by bonding the front crotch gusset panel seam 128*a* they have obtained the following surprising and unexpected results: an increase in the seam's ability to stretch and "recover," (i.e., to return to its original shape), an enhanced stretch (i.e., stretching more than a seam constructed with conventional needle and thread stitching), and improved comfort and garment performance (The absence of internal exposed threads reduces the risk of abrasive contact with the skin, which, in turn, reduces chafing and improves general performance).

The center-front pouch 112 connects at the front crotch gusset panel seam 128*a* to create extra 3D fit, in order to improve the wearers "stride" when walking, running or even sitting. The garment with legs 110 expands and, at the same time, supports the male genitals, preventing them from making contact with the skin of the inner leg thigh, reducing chafing.

The rear crotch gusset panel seam 128*b* is the last seam to be executed, in order to "close" the garment. The rear crotch gusset panel seam 128*b* is sewn and not bonded as this seam is one of the largest stress points of the garment with legs 110.

Thus, as shown in FIG. 2, the crotch gusset panel 128 is secured to the front-side-and-rear panel 118 by double top stitching 128*c* along the rear crotch gusset panel seam 128*b*. As mentioned, there are also provided a pair of baby bar tacks 134, the baby bar tacks 134 being positioned substantially parallel to one another and perpendicular to the double top stitching 128*c*.

Still referring to FIG. 2, the present advantageous leg hem 132 is achieved by a combination feature comprising a self-turnback fold, bonded with adhesive stretch tape 132*b*. This advantageous combination features provides the dual benefits of comfort for the wearer 112, without compromising durability of the leg hem 132.

In particular, the leg hems 132 are finished with what is known in the art as a self-turnback hem, which is a double layer of self-fabric (i.e., a fabric piece made from the same fabric as the main fabric, as opposed to a contrast fabric), with a folded edge. The self-turnback hem is constructed by folding the seam allowance upwards on the interior of the garment. As mentioned above, the term "seam allowance" refers to the extra width of fabric that is beyond the seam line where the garment is stitched. This extra width of fabric is typically in the range of about 15-25 mm (or about ½"-1") for the leg hems 132 according to the present invention. Thus, the leg hem 132 seam allowance measures, in preferred embodiments of the present invention, 20 mm in width. The seam allowance is typically folded pushed or turned up into a direction, i.e., left, right, up, or down. Instead of sewing the hem with a conventional needle, the present inventor discovered surprising and unexpected results by bonding the seam allowance to the main body of the garment by using a 20 mm width BEMIS #3914 adhesive stretch tape. The bonded leg hem decreases chafing by reducing or eliminating any instances of interior abrasive sewing threads making contact with skin. The enhanced stretch and recovery of the bonded leg hem enhances the support of the hem, and prevents it from over-stretching and riding up. It also provides a very comfortable stretch modulus which expands and contracts with leg muscles for support and ease of movement.

It will be appreciated that the present invention provides the advantage of a side-seam free garment. That is, there is no side seam dividing the front and back regions of the garment.

FIGS. 7 to 12 illustrate a second embodiment of the invention in the form of a brief 210, provided with a center-front pouch 212.

Figure 10:
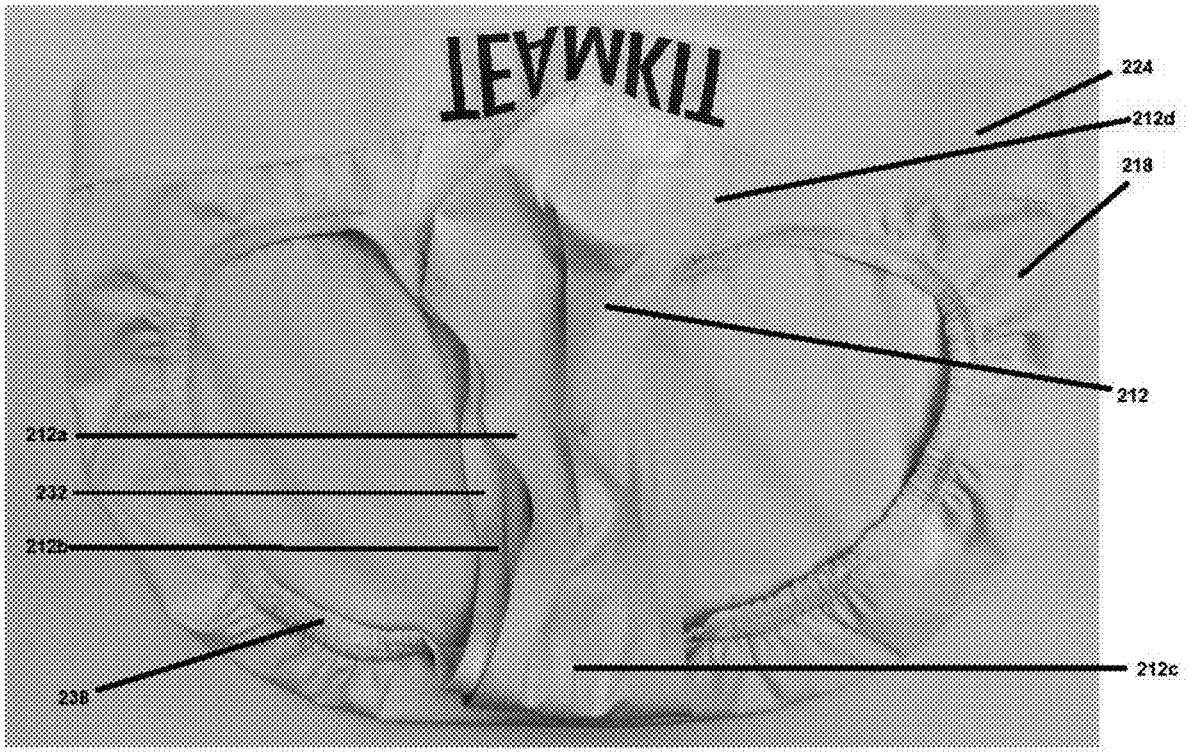
FIG. 10 is a front view of the interior of the brief embodiment according to the present invention.
Figure 11:
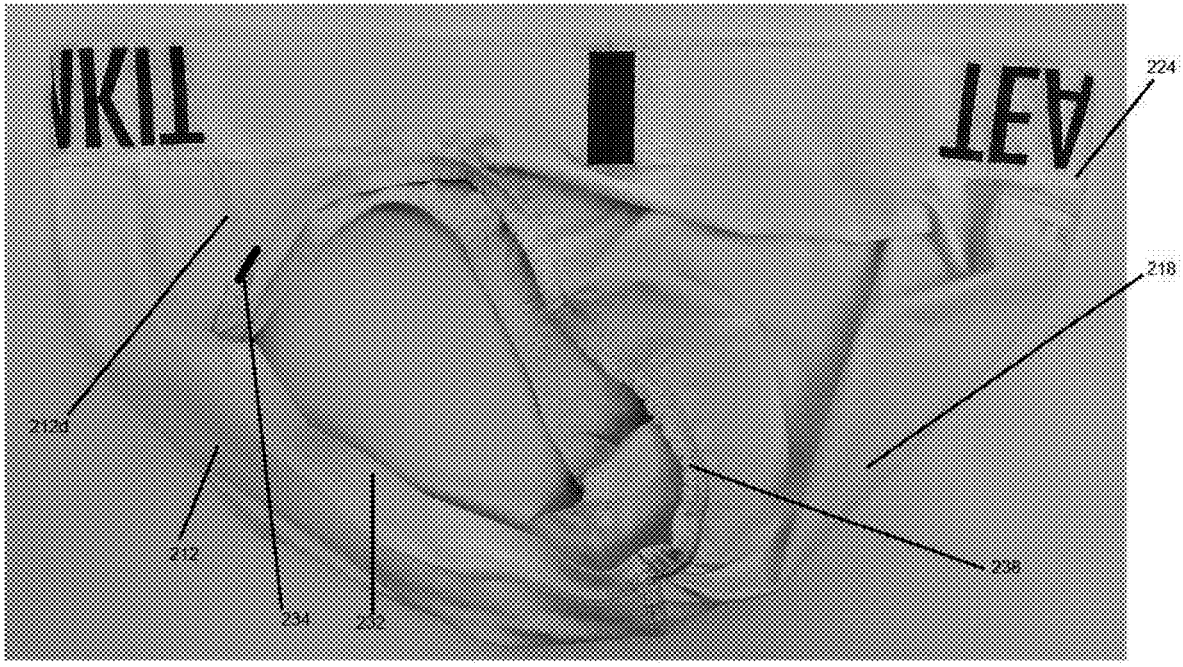
FIG. 11 is a side view of the interior of the brief embodiment according to the present invention.
Figure 12:
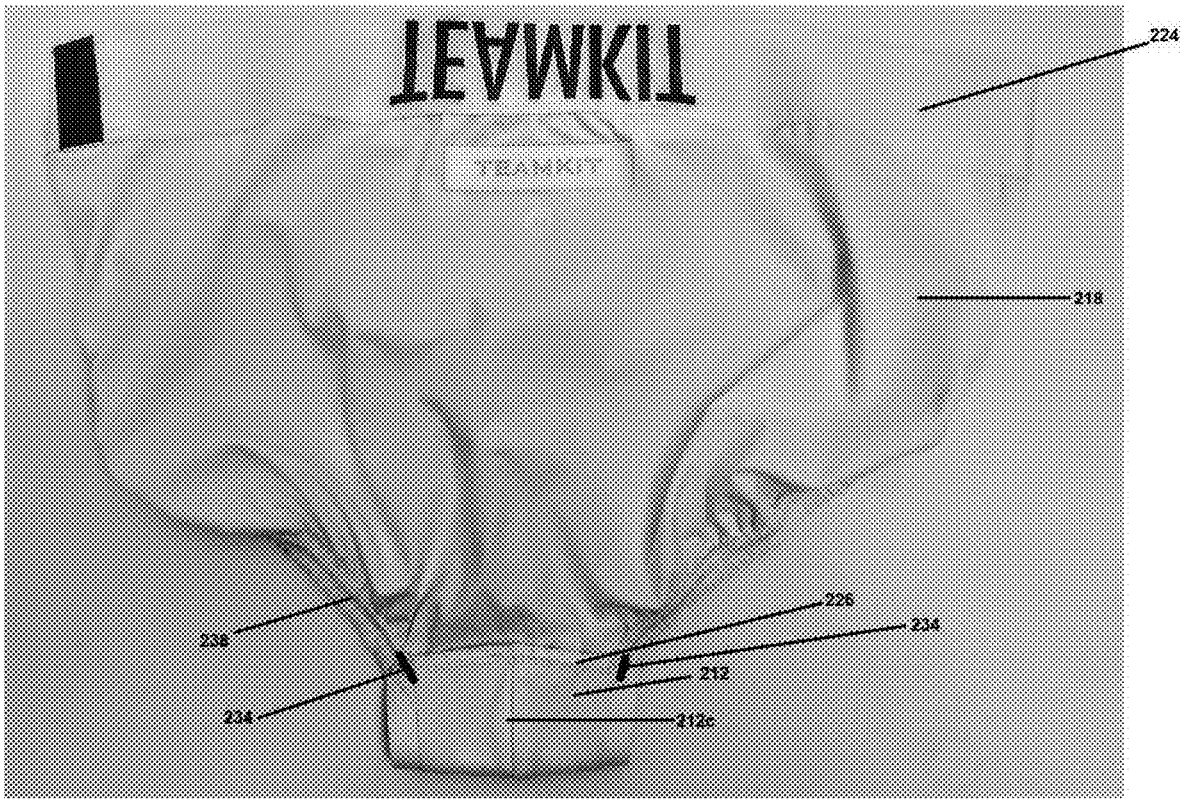
FIG. 12 is a side view of the interior of the brief embodiment according to the present invention

FIGS. 10, 11 and 12 show front, side, and rear views, respectively, of the interior of the brief 210 embodiment according to the present invention. The brief 210 includes a front-side-and-rear panel 218 which bounds the center-front pouch 212 on either side of the center-front pouch 212.

In preferred embodiments, the center-front pouch 212, the front-side-and-rear panel 218 are each made of stretch-knit fabric. In preferred embodiments, the stretch-knit fabric has a weight in the range of 167 g/m$^2$ to 220 g/m$^2$.

As with the garment with legs 110 embodiment, in preferred embodiments of the brief 210 embodiment, the center-front pouch 212 is composed of two layers of material, an inner layer 212*a* and an outer layer 212*b*. The inner and outer layers 210 and 212*b* are joined by a center seam 212*c* of the center-front pouch 212.

As shown in FIGS. 10 and 12, the center seam 212*c* of the center-front pouch 212 runs from the upper edge of the brief 210 to the lower edge of the center-front pouch 212, where the center-front pouch 212 meets the bottom of the front-side-and-rear panel 218.

Figure 7:
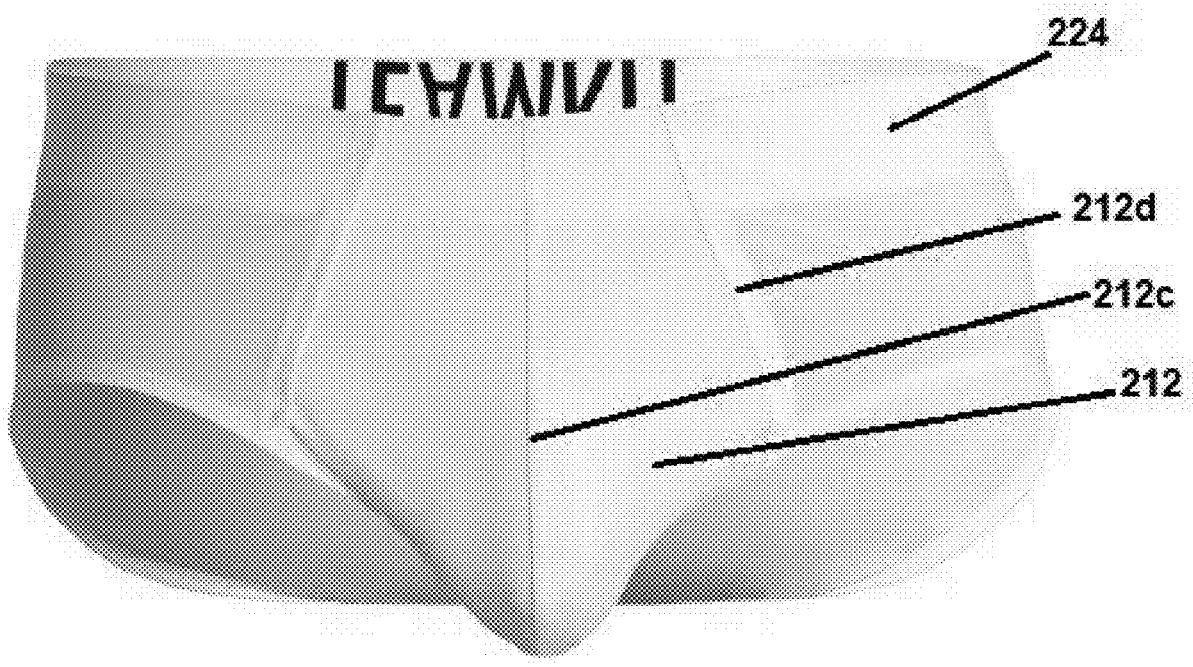
FIG. 7 is a front view of the outside of the brief embodiment according to the present invention.
Figure 8:
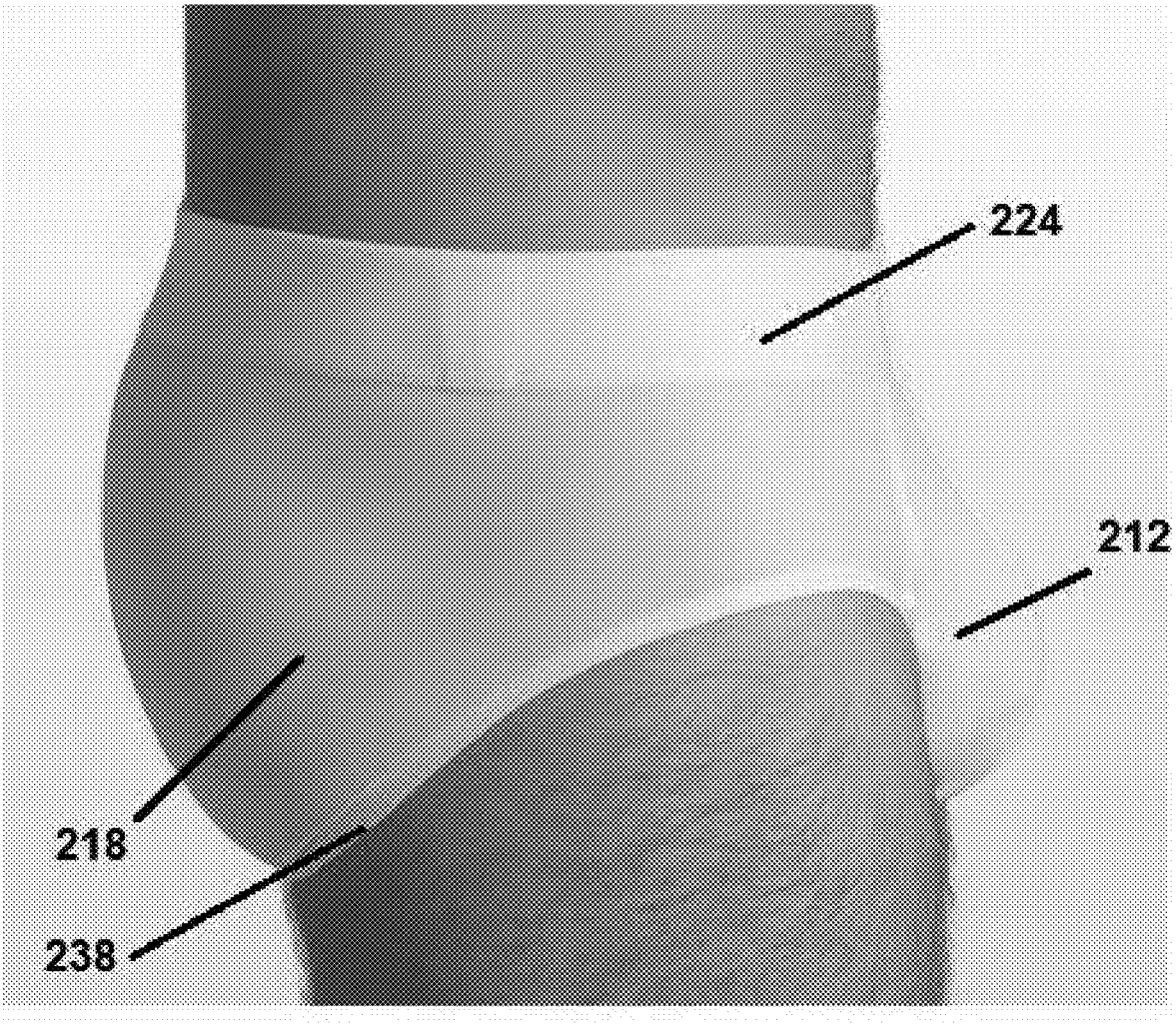
FIG. 8 is a side view of the outside of the brief embodiment according to the present invention.
Figure 9:
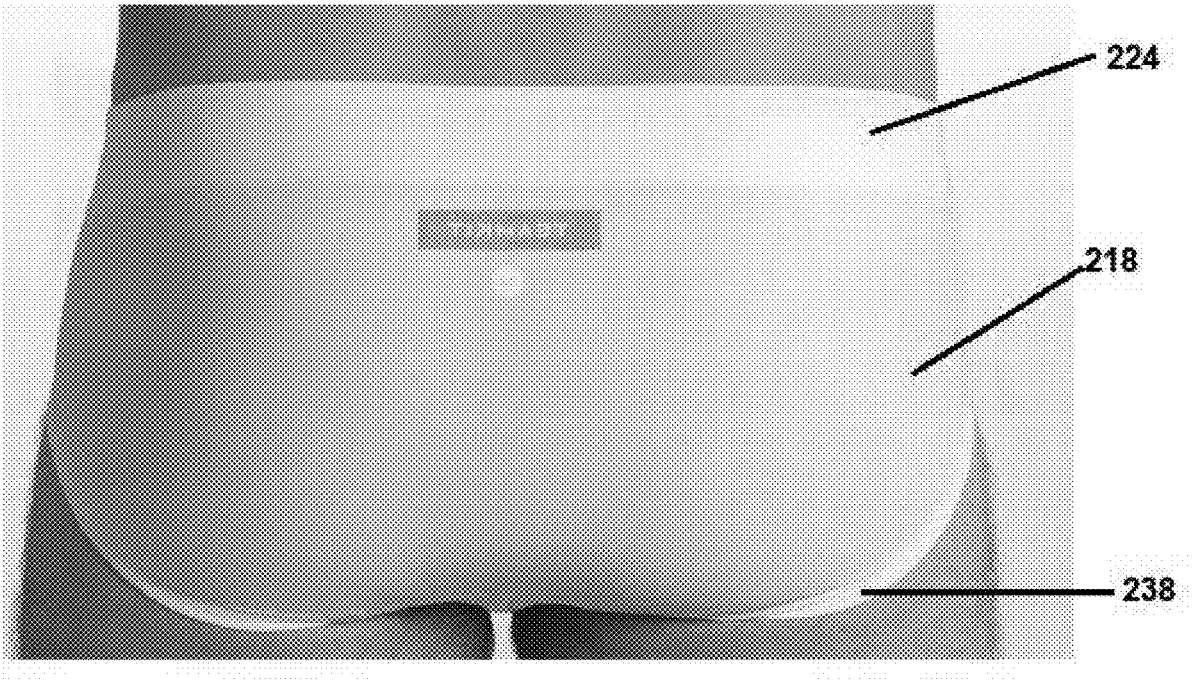
FIG. 9 is a rear view of the outside of the brief embodiment according to the present invention.

As seen in FIGS. 7 and 10, a pair of outer seams 212*d* of the center front pouch 212 bound the upper portion of the center-front pouch 212 on either side of the center-front pouch 212. Starting at the top edge of the brief 210, the outer seams 212*d* of the center front pouch 212 slope away from an axis defined by the center-front pouch seam 212*c*. The center-front pouch 212 is bounded along its upper edge by the waistband 224. The center-front pouch is bordered at its lower and rearmost edge by the front-side-and-rear panel 218, as best seen in FIG. 12.

With reference to FIGS. 10 and 11, the center-front pouch 212 and the side-and-rear panel 218 cooperate to define leg openings. The center-front pouch 212 and the rear-and-side panel 218 are joined along outer seams 212*d* of the center front pouch 212.

As can be seen in FIGS. 10 and 11, which show interior views of the garment, the inner layer 212*a* of the center-front pouch 212 is not sewn into the leg hem 232. As can also be seen, the inner pouch layer 210 is detached from the leg hem 232. The inner pouch layer 210 has a cut edge with no self-turnback. In preferred embodiments, the cut edge is bonded on one side with one-sided adhesive stretch tape. The inventor discovered that this provides the advantage that fabric lays flat and does not curl or create bulk. It is also preferable for the one-sided adhesive stretch tape to be lightweight and clear, preferably BEMIS #3412 tape.

With reference to FIG. 11, the region of each leg opening that is proximate to the inner thigh, that is, the hem line of the outer layer 212*b* of the center-front pouch 212 is finished with a self-turnback hem. The self-turnback hem is advantageously bonded with adhesive stretch tape. In preferred embodiments, the adhesive stretch tape used to bond the self-turnback hem is BEMIS #3914 adhesive stretch tape. In preferred embodiments, the BEMIS #3914 seam tape used to bond the self-turnback hem has a width in the range of 7 mm to 10 mm.

Thus, advantageously, the inner layer 212*a* and the outer layer 212*b* of the center-front pouch 212 are joined at the central seam 212*c* but are separated along their respective outer edges. As can be seen in FIGS. 10 and 11, the inner layer 212*a* of the center-front pouch 212 is not sewn into the inner thigh leg hem. Thus, the advantages of a double layer center-front pouch 212 are provided without the unneeded stitching along the edges of the inner and outer layers 210, 212*b*, where the center-front pouch 212 contacts the inner thigh of a wearer, an advantage over typical prior art briefs.

As best seen in FIG. 11, in the present invention, the portion of the brief 210 which contacts the inner thigh of the wearer 214 is advantageously non-chafing whereas the elastic portion, discussed below, is distant from and does not contact the inner thigh. The present invention, therefore, provides the advantages of elasticity and a secure-fit "grip," without the chafing and/or discomfort which normally results from contact of elastic features with the inner thigh of a wearer.

FIG. 11 shows the advantageously elasticized rear hem portion 238 which, in preferred embodiments, is a self-turnback hem.

The elasticized rear hem portion 238 is constructed by turning the seam allowance back towards the interior of the garment and inserting a narrow piece of thin elastic—in typical embodiments, about 7.5 mm in width. The elasticized rear hem portion 238 is finished with double needle elasticized stretch stitch topstitching.

Advantageously, as show in FIG. 11, there are provided baby bar tacks 234 along the portion of the elasticized seam 238 which contacts the center-front pouch 212.

As seen in FIG. 12, the center-front pouch 212 meets the bottom of the rear-and-side panel 218 at rear seam 226. Advantageously, two baby bar tacks 234 are provided perpendicular to the rear seam 226, approximately equidistant from the point at which the center seam 212*c* of the center-front pouch 212 meets the rear seam 226.

Thus, it will be appreciated that in preferred embodiments, garments according to the present invention are preferably made with stretch-knit fabric having a weight in the range of 167 g/m$^2$ to 220 g/m$^2$. In preferred embodiments, the seams which are bonded are bonded by applying BEMIS #3914 adhesive stretch tape and employing a bonding machine, preferably a FRAMIS bonding machine, available from Framis Italia SpA, in MI, Italy and employing a heat press, preferably a MACPI heat press, available from Macpi SpA in BS, Italy. In preferred embodiments, BEMIS #3914 adhesive stretch tape having a width in the range of 7 mm to 10 mm is used to bond the seams according to the present invention, which was found by the present inventor to be surprisingly advantageous for achieving the objects of the present invention described herein. In preferred embodiments, BEMIS #3914 adhesive stretch tape having a width in the range of 15 mm to 25 mm is used to bond the leg hems according to the present invention, which was found by the present inventor to be surprisingly advantageous for achieving the objects of the present invention described herein. This particular formula was arrived at by the inventor after extensive experimentation involving numerous fabrics of different weights with adhesive stretch tapes of different types and widths. Among other trials, the inventor discovered that, for example, fabric having a weight of 117 g/m$^2$ did not work with the tape of choice, Bemis #3914. As a result of the tape being too strong relative to the fabric weight, the seams would ripple and would fail to recover their original shape. Further, when the inventor increased the weight of the fabric to 164 g/m$^2$, the fabric weight was still too light and the power of the tape caused the seams to ripple and fail to recover their original shape. When the inventor increased the weight of the fabric to 167 g/m2 the inventor found an ideal match between the fabric and a desired adhesive stretch tape, namely Bemis #3914.

Further, when the inventor tried a heavier weight of the fabric, increasing to 200 and 220 g/m2 it was found that Bemis #3914 worked perfectly. This higher weight of fabric is preferable for garments that are more in the sportswear classification than the undergarment classification.

Accordingly, the present invention also concerns a method of making an undergarment, which includes the steps of providing a center-front pouch, providing a front-side-and-rear panel and providing a crotch gusset panel. According to the method the front-side-and-rear panel is joined to the center-front pouch at least partially on either side of the center-front pouch. The front-side-and-rear panel is joined to the center-front pouch by a pair of convex outer seams. The center-front pouch defines a peak, the peak effected by the convex tracking of the convex outer seams away from an axis defined by the center seam.

Also, according to the method, the crotch gusset panel is joined to the center-front pouch and the front-side-and-rear panel, along a front side of the crotch gusset panel, by a front crotch gusset panel seam. The front crotch gusset panel seam extends laterally along a bottom edge of the center-front pouch and a bottom edge of the front-side-and-rear panel.

The method further includes the step of joining the crotch gusset panel to the front-side-and-rear panel, along a rear side of the crotch gusset panel by a seam, by rear crotch gusset panel seam. The rear crotch gusset panel seam extends laterally along a bottom edge of the front-side-and-rear panel. The front-side-and-rear panel and the crouch gusset panel are joined so as to define two leg openings.

The method also includes bonding steps. In particular, the method includes the step of bonding each seam of the pair of convex outer seams by providing adhesive stretch tape, preferably BEMIS #3914 adhesive stretch tape having a width in the range of 7 mm to 10 mm, along the length thereof;

The method also includes the step of bonding the front crotch gusset panel seam by providing adhesive stretch tape, preferably BEMIS #3914 adhesive stretch tape having a width in a range of 7 mm to 10 mm, along the length thereof.

The method further includes the step of forming leg hems along the leg openings by forming a self-turnback fold and applying adhesive stretch tape, preferably BEMIS #3914 adhesive stretch tape having a width in a range of 15-25 mm, along the length thereof.

According to method the center-front pouch, the front-side-and-rear panel and the crotch gusset panel provided are each made of stretch-knit fabric having a weight in the range of 167 g/m$^2$ to 220 g/m$^2$.

Also, according to the method, the steps of bonding the convex outer seams, front crotch gusset panel seam, and the leg hems further include employing a bonding machine, preferably a FRAMIS bonding machine.

Additionally, according to the method, the steps of bonding the convex outer seams, front crotch gusset panel seam, and the leg hems further include employing a heat press, preferably a MACPI heat press.

While specific embodiments of the invention have been shown and described in detail to illustrate the application of the principles of the invention, it will be understood that the invention may be embodied otherwise without departing from such principles.

What is claimed is:

1. An undergarment, comprising a center-front pouch having a right side and a left side;

a front-side-and-rear panel; and a crotch gusset panel, wherein the front-side-and-rear panel is joined to the center-front pouch at least partially on the right side and the left side of the center-front pouch, wherein the front-side-and-rear panel is joined to the center-front pouch by two convex outer seams, wherein the center-front pouch defines a peak, the peak effected by a convex tracking of the two convex outer seams away from an axis defined by a center seam, wherein the crotch gusset panel bounds the center-front pouch along a bottom edge of the center-front pouch, wherein the crotch gusset panel extends laterally along the bottom edge of the center-front pouch and a bottom edge of the front-side-and-rear panel, the crotch gusset panel sharing common seams with each of the center-front pouch and the front-side-and-rear panel, wherein the crotch gusset panel is joined to the center-front pouch and the front-side-and-rear panel by a front crotch gusset panel seam, and the crotch gusset panel is joined to the front-side-and-rear panel by a rear crotch gusset panel seam, wherein the center-front pouch is comprised of an inner layer and an outer layer, the inner and outer layers being joined by the center seam, wherein the center-front pouch, the front-side-and-rear panel and the crotch gusset panel are each made of stretch-knit fabric, wherein each seam of the pair of convex outer seams is bonded with adhesive stretch tape, wherein the front crotch gusset panel seam is bonded with adhesive stretch tape, and wherein a seam allowance of the center-front pouch seam of the center-front pouch is folded within the inner layer and the outer layer of the center-front pouch.

2. The undergarment according to claim 1, wherein the center seam of the center-front pouch runs from an upper edge of the undergarment to a lower edge of the center-front pouch.

3. The undergarment according to claim 1, wherein the center-front pouch has an upper edge, wherein the center front pouch is bounded along the upper edge by a waistband.

4. The undergarment according to claim 1, wherein the stretch-knit fabric has a weight in a range of 167 g/m2 to 220 g/m2.

5. The undergarment according to claim 4, wherein each seam of the pair of convex outer seams is bonded with adhesive stretch tape having a width in a range of 7 mm to 10 mm, and wherein the front crotch gusset panel seam is bonded with adhesive stretch tape having a width in a range of 7 mm to 10 mm.

6. The undergarment according to claim 4, wherein the front-side-and-rear panel and the crouch gusset panel cooperate to define two leg openings, further comprising leg hems along the leg openings.

7. The undergarment according to claim 6, wherein each leg hem is a combination feature comprising a self-turnback fold, bonded with adhesive stretch tape.

8. The undergarment according to claim 7, wherein the adhesive stretch tape of each leg hem has a width in a range of 15-25 mm.

9. The undergarment according to claim 1, wherein baby bar tacks are located perpendicular to an overlap between the center-front pouch and the crotch gusset panel, perpendicular to an overlap between the crotch gusset panel seam and the front-side-and-rear panel, and perpendicular to an overlap between the crotch gusset panel and each of the leg hems.

10. The undergarment according to claim 1, wherein a seam joining the crotch gusset panel to the center-front pouch and the front-side-and rear panel is bonded along its length with adhesive stretch tape.

11. A method of making the undergarment according to claim 1, comprising the steps of:

providing the center-front pouch;

providing the front-side-and-rear panel;

providing the crotch gusset panel;

joining the front-side-and-rear panel to the center-front pouch at least partially on the right side and the left side of the center-front pouch, wherein the front-side-and-rear panel is joined to the center-front pouch by the two convex outer seams;

joining the crotch gusset panel to the center-front pouch and the front-side-and-rear panel, along a front side of the crotch gusset panel, by the front crotch gusset panel seam which extends laterally along the bottom edge of the center-front pouch and the bottom edge of the front-side-and-rear panel, joining the crotch gusset panel to the front-side-and-rear panel, along a rear side of the crotch gusset panel by the rear crotch gusset panel seam which extends laterally along the bottom edge of the front-side-and-rear panel, wherein the front-side-and-rear panel and the crouch gusset panel are joined so as to define two leg openings;

bonding each of the two convex outer seams by providing the adhesive stretch tape of the two convex outer seams, the adhesive stretch tape of the two convex outer seams having a width in the range of 7 mm to 10 mm along the length thereof;

bonding the front crotch gusset panel seam by providing an adhesive stretch tape having a width in a range of 7 mm to 10 mm along the length thereof; and forming leg hems along the leg openings by forming a self-turnback fold, and bonding the self-turnback fold with an adhesive stretch tape having a width in a range of 15-25 mm along the length thereof.

12. The method according to claim 11, wherein the steps of bonding the convex outer seams, front crotch gusset panel seam, and the leg hems further comprise employing a bonding machine.

13. The method according to claim 11, wherein the steps of bonding the convex outer seams, front crotch gusset panel seam, and the leg hems further comprise employing a heat press.

14. The method according to claim 11, wherein the stretch-knit fabric has a weight in the range of 167 g/m2 to 220 g/m2.

15. An undergarment, comprising a center-front pouch having a right side and a left side; and a front-side-and-rear panel;

wherein the front-side-and-rear panel bounds the center-front pouch at least partially on the right side and the left side of the center-front pouch, wherein the center-front pouch is comprised of an inner layer and an outer layer, the inner and outer layers being joined by a center seam of the center-front pouch, wherein the inner layer and the outer layer of the center-front pouch are joined at the center seam, wherein two outer seams of the center-front pouch bound an upper portion of the center-front pouch on the right side and the left side of the center-front pouch, wherein the two outer seams of the center-front pouch slope away from an axis defined by the center seam, wherein the inner layer has an edge turnback which is bonded with adhesive stretch tape, wherein a hem line of the outer layer of the center-front pouch is finished with a self-turnback hem, wherein the center-front pouch and the front-side-and-rear panel are each made of stretch-knit fabric;

wherein the outer layer forms part of a leg hem, and wherein the outer layer forms a crotch gusset, wherein the left side and the right side of the center-front pouch each form a part of the leg hem, wherein the inner layer is detached from the leg hem.

16. The undergarment according to claim 15, wherein the center-front pouch has an upper edge, and wherein the center-front pouch is bounded along the upper edge by a waistband.

17. The undergarment according to claim 15, wherein the stretch-knit fabric has a weight in a range of 167 g/m2 to 220 g/m2.

18. The undergarment according to claim 17, wherein the center-front pouch and the side-and-rear panel cooperate to define leg openings.

19. The undergarment according to claim 17, wherein the self-turnback hem of the outer layer of the center-front pouch is bonded with adhesive stretch tape.

20. The undergarment according to claim 17, further comprising an elasticized hem portion along at least one edge of the front-side-and-rear panel.

21. The undergarment according to claim 19, wherein the adhesive stretch tape has a width in a range of 7 mm to 10 mm.

* * * * *